US006497264B1

(12) United States Patent
Paskevicius

(10) Patent No.: US 6,497,264 B1
(45) Date of Patent: Dec. 24, 2002

(54) BLINDS

(76) Inventor: Stefan Zigmas Paskevicius, 8 Derrima Crecent, Ferny Hills, Queensland, 4055 (AU)

( * ) Notice: Subject to any disclaimer, the term of this patent is extended or adjusted under 35 U.S.C. 154(b) by 0 days.

(21) Appl. No.: 09/144,476

(22) PCT Filed: Feb. 28, 1997

(86) PCT No.: PCT/AU97/00125

§ 371 (c)(1),
(2), (4) Date: Jul. 9, 2001

(87) PCT Pub. No.: WO97/32105

PCT Pub. Date: Sep. 4, 1997

(30) Foreign Application Priority Data

Mar. 1, 1996 (AU) ..... PN8389
Oct. 23, 1996 (AU) ..... PO3152

(51) Int. Cl.[7] ..... A47H 5/00
(52) U.S. Cl. ..... 160/84.04
(58) Field of Search ..... 160/84.01, 84.04, 160/84.05, 348, 264, 84.06, 405

(56) References Cited

U.S. PATENT DOCUMENTS 3,777,800 A * 12/1973 Susoev ..... 160/84.04
3,999,590 A * 12/1976 Koch ..... 160/84.01
4,934,435 A * 6/1990 Regev ..... 160/84.04
5,273,096 A * 12/1993 Thomsen et al. ..... 160/84.01
5,566,735 A * 10/1996 Jelic ..... 160/84.04
5,649,583 A * 7/1997 Hsu ..... 160/84.05
5,690,156 A * 11/1997 Ruggles ..... 160/84.04
5,862,850 A * 1/1999 Yang ..... 160/84.01 X

* cited by examiner

*Primary Examiner*—David M. Purol
(74) *Attorney, Agent, or Firm*—Quirk & Tratos

(57) ABSTRACT

A shade comprising a fabric having divider strips dividing the fabric into panels of predetermined outline, each strip being sewn or otherwise secured directly to the fabric in fixed relation thereto and draw cords extending in operative relation to the divider strip so that the divider strips form focal lines for folding of the sheet of fabric as the cords are drawn.

19 Claims, 13 Drawing Sheets

BLINDS

FIELD OF THE INVENTION

THIS INVENTION relates to improvements in or in relation to blinds particularly to those known as "roman shades" and more particularly but not limited thereto to, baton, cascade roman, oriental, panel, brick, diamond and other patterned roman shades. The present invention has particular application to the above named forms of roman shades but has general application to any type of shade where the present invention can be employed.

BACKGROUND ART

Roman shades are normally used as window furnishings, room dividers, privacy screens, awnings, wardrobe screens and the like applications. They can by made from natural or synthetic fabric materials. Examples of the materials include bonded fabrics, suede lined or coated fabrics, loose lined, sunscreen or sheer fabrics, canvas, plain or printed fabric.

Roman shades usually employ parallel spaced timber divider strips slidably held in pockets and operable by draw cords so that the divider strips form focal lines for folding of the shade as the cords are drawn.

Manufacture of a standard roman shade typically involves the following steps:

(i) measuring out the fabric;

(ii) hemming the fabric;

(iii) measuring the position and spacing of the lath pockets, for parallel operation of the laths;

(iv) sewing the pockets;

(v) inserting timber dowels into the pockets; and (vi) hang the shade.

As a roman shade is a visual element any pockets that are even marginally out of parallel can create an undesirable appearance in the finished blind as the human eye is very perceptive to misalignment of this kind. Due to the construction of the roman blind, errors in measurement at step (iii) and or in sewing at step (iv) cannot be easily corrected.

One effort to simplify the process is disclosed in Australian patent application No. 74080/91 to Schon B. V. The specification discloses a retractable roman shade where shade laths are formed from an assembly comprising a strip and a fabric retainer rod insertable into the strip, the strip including a channel, the channel having a resilient clip entry receiving the retainer rod used to push fabric into and retain the fabric in the channel. This in effect displaces the fabric along the line of the strip and by using a number of these the usual focal lines for operation of the roman shade are formed. The main problem with this arrangement is that particularly for thin fabrics the strips tend to move relative to the fabric.

As a consequence of these inherent requirements for accuracy the construction of roman shades is a time consuming labour intensive process. The process also are requires a high level of machinist skill. Some of the more complex shapes such as cascade roman and baton roman are even more difficult and time consuming to make than the simpler forms.

Although variations on roman blinds have been adopted by various manufacturers in an effort to reduce labour and time none have found a simple solution.

For example, the use of an interference fit between the fabric pinched between the rod and the channel as shown in the Australian Patent application No. 740870/91 is unsuitable for thicker fabrics which simply do not fit. In addition a problem also common to other roman blinds is that the fabric gathered at the lath is effectively wasted fabric. Furthermore where a patterned or printed fabric is used the gathered fabric at the lath breaks the continuity of the pattern, again with undesirable visual effect. Simply put all the prior art lath arrangements even having regard to the time and labour factors are really only suitable for plain fabric due to this disruption of the pattern arising from gathering of the fabric at the lath.

Nevertheless it is undesirable in a Roman shade to completely eliminate pleats as the pleats give the roman shade its traditional identity but it would be desirably to retain the roman shade style but alleviate the problems of the prior art.

It is an object of the present invention to provide a method of constructing roman type blinds whereby a quick accurate result can be obtained with less time than using the prior art methods.

OUTLINE OF THE INVENTION

In one aspect, therefore, the present invention resides in a shade comprising a fabric having a plurality of horizontal divider strips adhered directly to the fabric in fixed relation thereto by sewing or equivalent technique, a plurality of draw cords extending through one or more of the divider strips so that the divider strips form focal lines for folding of the shade as the cords are drawn. The invention embraces all known means of securing a divider strip directly to the fabric in fixed relation thereto. Examples of the securing means include stapling, adhesive, fusion, welding, clamping etc.

In the traditional roman shade stitching is generally disguised by the shape and position of the pockets or the fabric colour, but generally visible stitching is considered undesirable, particularly where light can pass through stitch holes. In another preferred aspect therefore, the present invention resides in a lath assembly comprising a divider strip suitable for being adhered to a fabric in fixed relation thereto by sewing or equivalent technique and a cover member coupled to the strip. Preferably the divider strip is made from a base strip having a longitudinal fold line and the strip is formed when the base strip is folded about the fold line, the cover member being adapted to maintain the strip in the folded form. Where the strip is sewn to a fabric the cover member is automatically positioned when connected in order to prevent light being transmitted through the stitch holes.

The divider strips can comprise any stiffened material that can be adhered to the fabric. The divider strip can be made up of discrete strip elements adhered to the fabric to form an effective strip extending across the fabric. Each strip can be adhered directly to the fabric by sewing or equivalent technique or can be employed to deform the fabric to give a predetermined special effect.

In one example, the strips are formed as laminated fabric or a flexible cord. The laminated fabric is typically formed from fabric layers glued or otherwise secured together. The cord is typically a multi fibre cord having a braided outer-wall enabling the cord to flex and move in response to shade fabric movement. Strip thicknesses up to 5 mm thick can be used but 3 mm is typical. Clearly this aspect allows the lath assembly to flex to some degree in response to shrinkage of the shade fabric. A similar embodiment employs a flexible cord or other flexible filamentary material where the lath assembly allows lateral and particularly longitudinal adjustment of the lath assembly in response to shade fabric compression arising through shrinkage.

For high shrinkage rates in one form the lath assembly is formed from a notched or a serpentine shaped strip, the strip typically being made from a preformed plastics or woven onto the shade fabric from a cord wound in a serpentine form. In another form the lath assembly is made from discrete elements woven or otherwise secured at spaced intervals to the shade fabric so that the elements together form an effective strip that can move in response to shrinkage of the shade fabric.

In another aspect the strips are formed as a plastics strip 1 mm to 5 mm thick and 3 mm to 30 mm wide. Where plastics are employed the strips can include ring attachment means for securing a cord guide ring or the like. Strips made of aluminium can be as thin as 0.2 mm so that it can be sewn to the fabric. In another embodiment the strips include foldable portions and possibly also clip means for securing the fordable portions together so that the strips can be pressed into the fabric and as the strips are folded and clipped together the fabric follows a predetermined deformation in order to provide a predetermined effect on the opposite side of the fabric.

Where the lath assembly comprising one or more flexible cords adhered to the fabric, the cords can be used to retain a cover member clipped to the cord to add substance to the lath assembly, with the cover member gathering shade fabric to automatically provide a particular desired shade type.

In another further aspect there is provided a lath assembly having a strip which is channel shaped and adhered directly to fabric, and a cover member having a recess in which the strip is fitted. The strip has a web portion and a side wall portion extending from each end of the web portion. The shade fabric is sewn on the exterior of the web portion. Preferably the side wall portions have flanges extending outwardly therefrom. Advantageously the recess has a shape complementary to the channel shaped strip so that the strip can be slid into the recess and be retained therein. The cover member has a ring or clip attachment means for a ring or clip to be attached thereto. The attachment means can be in the form of a restricted opening for the ring or clip to be slid in position. Preferably a plurality of rings or clips are provided spacedly along the assembly. In this invention the stitch holes on the strip are covered by the cover member to prevent ingress of light through the stitch holes.

In yet another further aspect of the present invention a lath assembly is provided and the assembly has a strip arranged within a recess of a cover member and at least one ring attachment member is secured to the cover member. The shade fabric is sewn on one side of the strip. The cover member has a restricted opening at the entrance of the recess for retaining the strip. Preferably the cover member is substantially C-shaped and includes a web portion, a side portion extending from each end of the web portion and a flange portion extending inwardly from the free end of each of the side portions. The web portion of the cover member may be provided with a groove for accommodating the stitching on the strip. The groove may be formed by a bent part on the web portion. Each ring attachment member is preferably channel shaped, and has a web portion and a side portion extending from each end of the web portion. A groove is provided in the attachment member for receiving a ring. The attachment member is provided with securing means for securing the attachment member to the cover member. Preferably a plurality of ring attachment members are spacedly arranged on the cover member. In this invention the stitch holes on the strip are also covered by the cover member and the attachment member to prevent ingress of light through the stitch holes.

In an alternative aspect of the present invention, a shade is provided, the shade comprising a fabric having a plurality of clip members secured to the fabric at predetermined positions for forming a particular pattern.

Preferably the pattern includes a brick configuration or a diamond configuration. More preferably the brick configuration represents stacking bricks. The diamond configuration includes an array of diamonds arranged in rows.

In one form the fabric has a plurality of divider strips adhered to the fabric, and the or selected clip members are connected to at least one of the divider strips.

Advantageously the clip members include a ring attachment means for accommodating a ring for a draw cord.

In another alternate aspect of the present invention, a clip member for a shade is provide. The clip member has a pair of jaws between which a part or a folded part of the shade fabric is secured. Any known means for securing the fabric to the jaws may be employed. The securing means can include sewing, stapling, gluing or clamping such as by a tube rivet.

The clip member may be formed in two compatible parts. Desirably each part includes one of the jaws and the two parts can be snap fitted together.

The clip member is conveniently configured to accommodate a cover member of the above described lath assembly. Alternatively it can be configured to accommodate the above mentioned lath assembly.

BRIEF DESCRIPTION OF THE DRAWINGS

In order that the present invention can be more readily understood and be put into practical effect reference will now be made to the accompanying drawings and wherein.

METHOD OF PERFORMANCE

Figure 3:
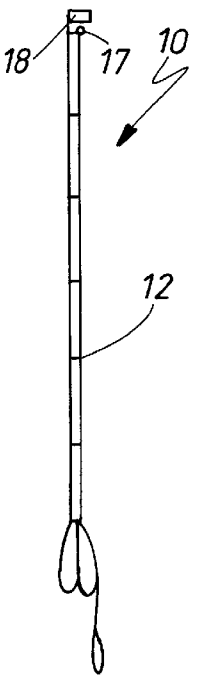
FIG. 3 is a side elevation similar to that of FIG. 2 but showing the roman blind partially folded.
Figure 2:
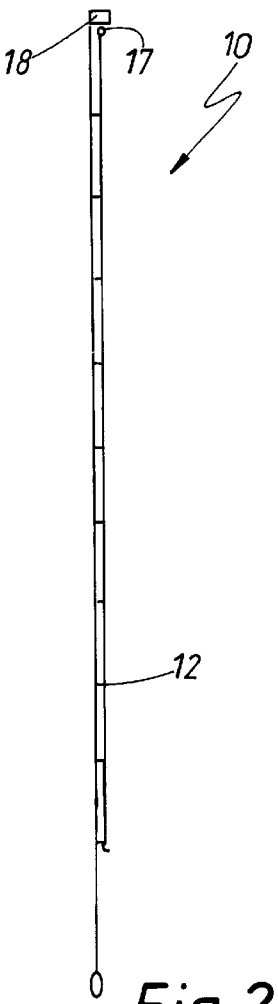
FIG. 2 is a side elevation showing the roman blind of FIG. 1 fully hung.
Figure 1:
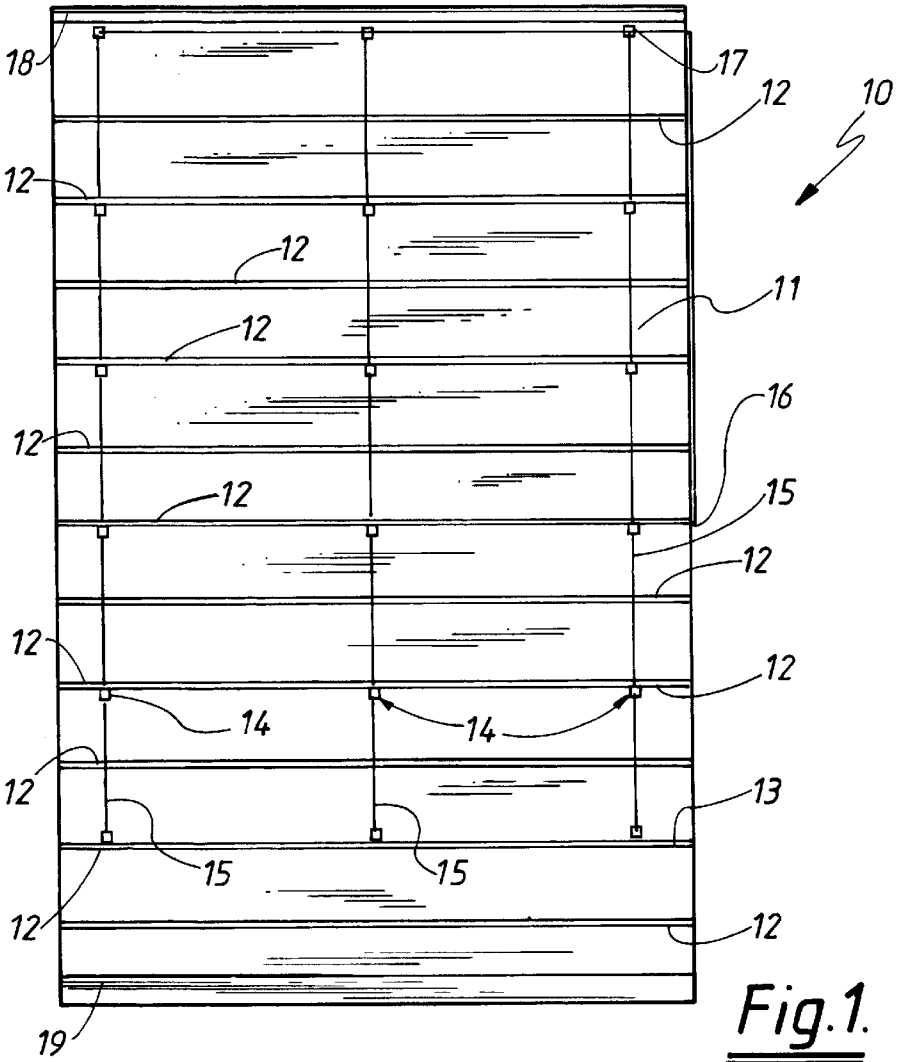
FIG. 1 is a rear view of a longer roman blind according to the present invention but is the same construction as depicted in FIGS. 1*a* and 1*b*.
Figure 1A:
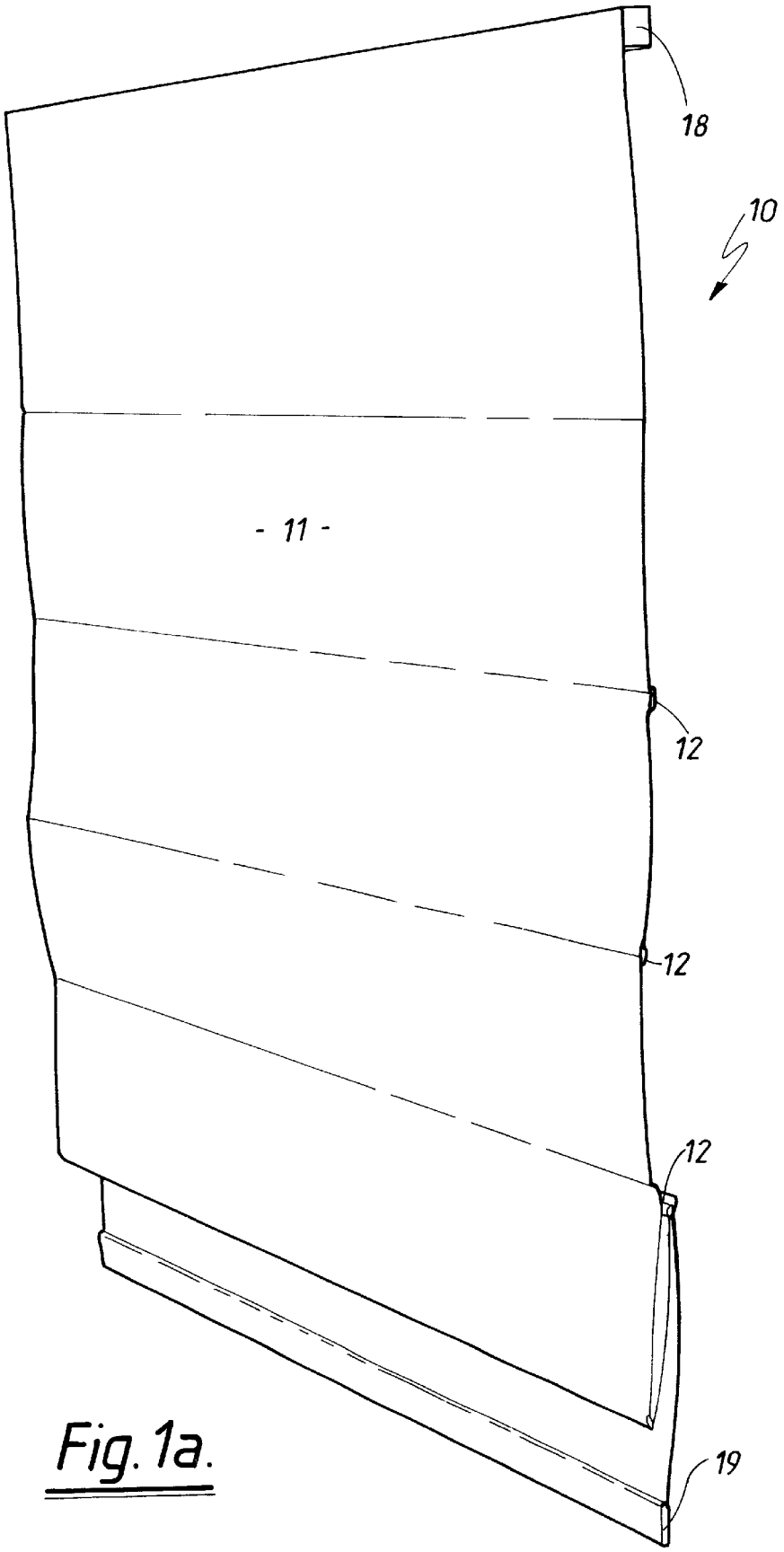
FIG. 1*a* is a front angle view of a typical roman blind according to the present invention.
Figure 1B:
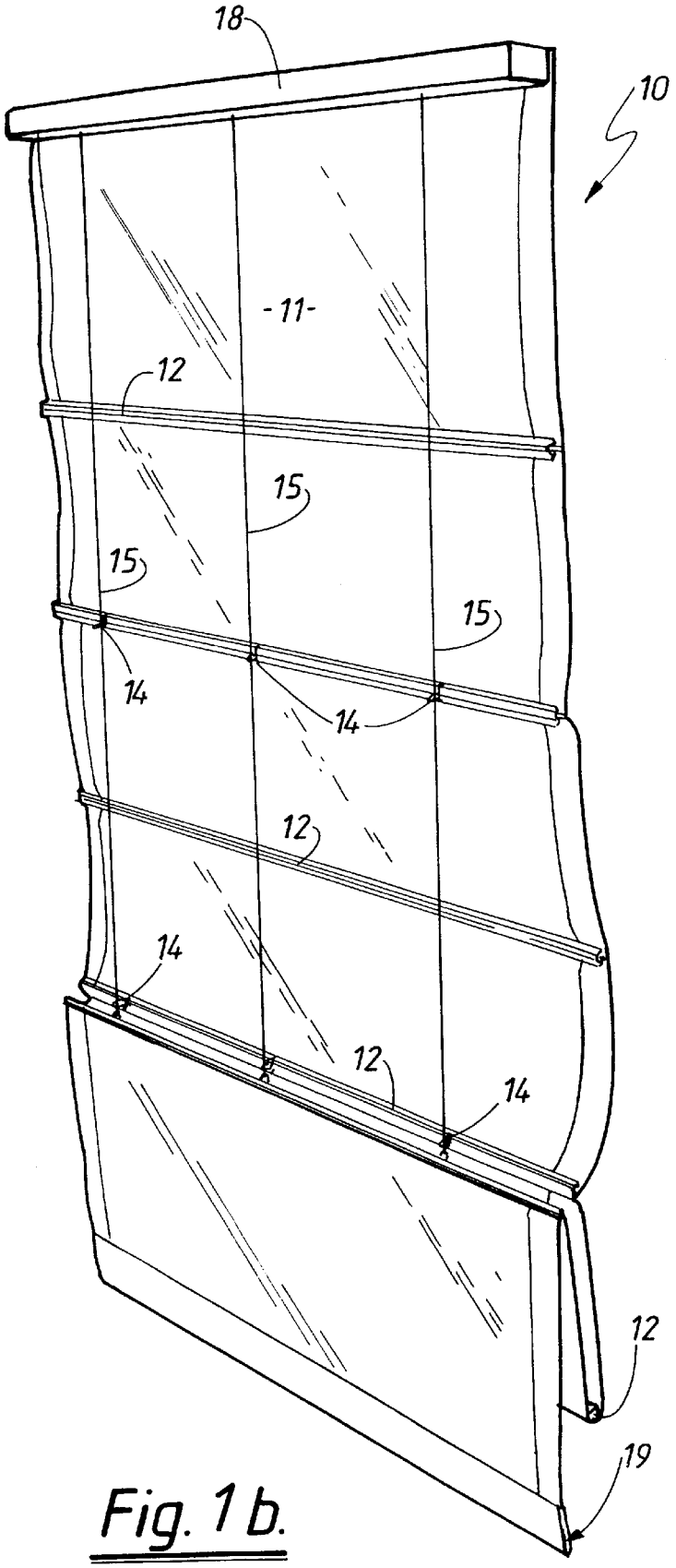
FIG. 1*b* is a rear angle of the blind illustrated in FIG. 1*a;*

Referring to the drawings and initially to FIGS. 1*a* to 3 there is illustrated a roman blind 10 including a fabric 11 and a plurality of divider strips 12. Selected strips 12 have guide rings 14. A lower one of the divider strips 13 has three spaced guide rings 14 to which draw or pull cords 15 are attached so that when the end of the draw/pull cords tied together at 16 as an acorn are pulled the roman blind begins to fold as illustrated in process in FIG. 3. Cord runners 17 are spacedly located adjacent to the top of the blind 10. The dividers 12 having the guide rings 14 form lift lines and the other dividers 12 form breaker lines. A head board or track 18 is positioned on top of the blind 10 and a bottom lath 19 at the bottom.

Figure 7:
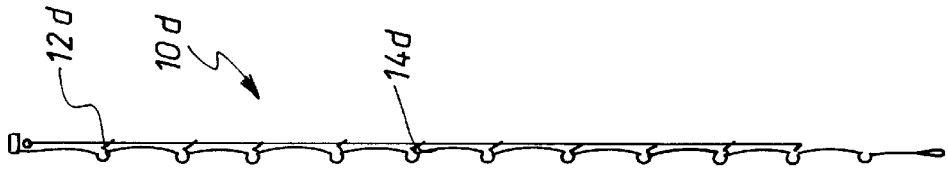
Figure 6:
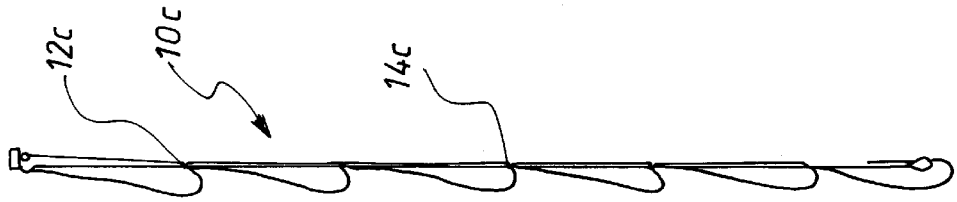
Figure 5:
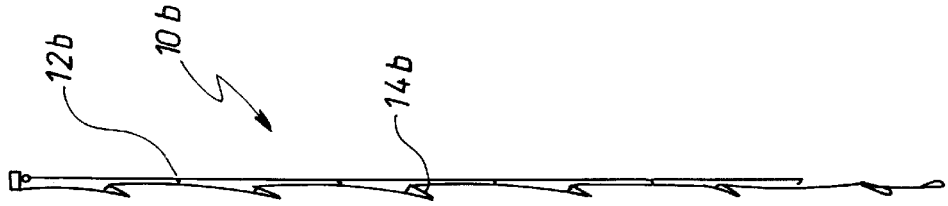
Figure 4:
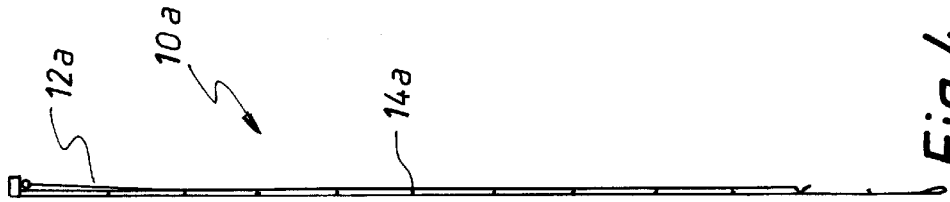

There are five most common forms of roman blinds and these are illustrated in FIGS. 4 to 8, FIG. 4 illustrating a flat roman 10*a*. FIG. 5 illustrating a baton roman 10*b*. FIG. 7 illustrating a cascade roman 10*c*. FIG. 6 an oriental roman 10*d* and FIG. 8 a panel roman 10*e*. The divider strips used in each case typically varies and these variations are illustrated in FIGS. 9 to 14.

Figure 9:
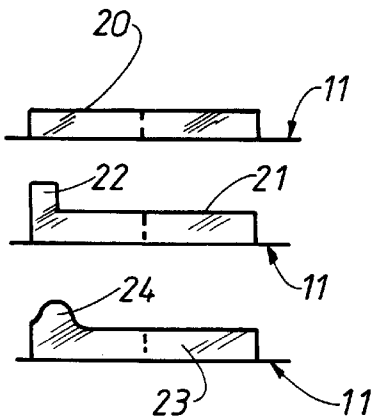

FIG. 9 illustrates a lightweight sew on strip functioning as a lath with variations illustrated at 20 and 21 where the lath includes a strengthening projection 22 and 23 an alternative form of strengthening projection 24.

Figure 8:
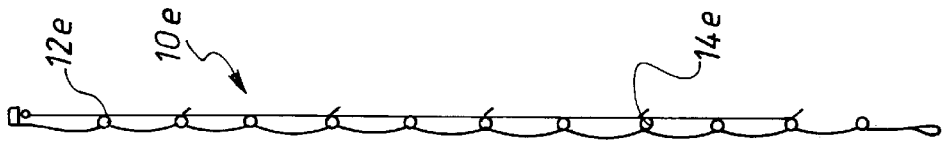
FIGS. 4 to 8 are five common forms of configurations of roman blinds to which the present invention can be applied.
Figure 11:
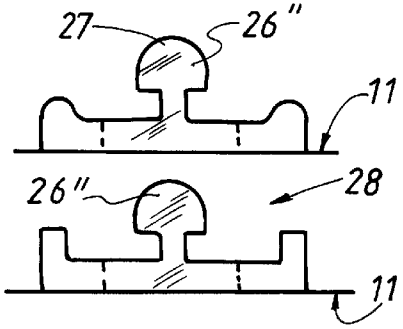
Figure 12:
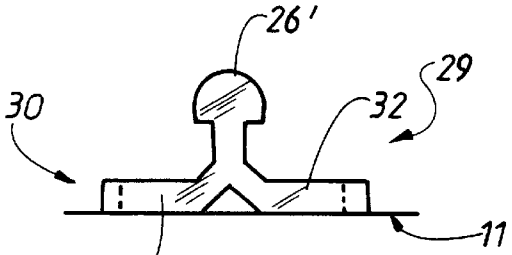
Figure 12:
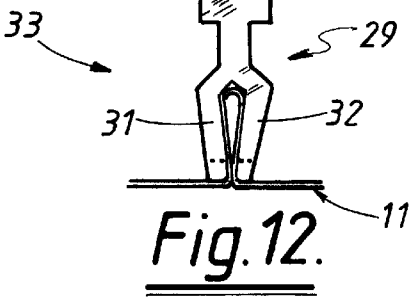
Figure 10:
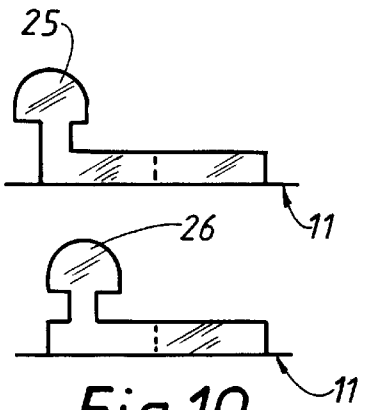
Figure 15:
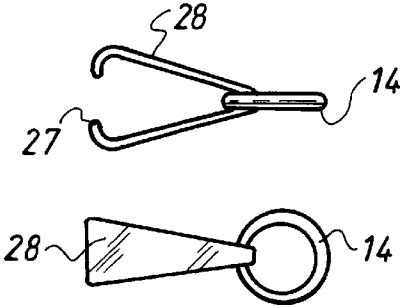
FIG. 15 illustrates clip on cord guide rings that can be secured to the divider strips illustrated in FIGS. 10 to 14.

FIG. 10 illustrates two variations of a sew on lath where the strip has a longitudinally extending projection which in section has a mushroom shape as illustrated in FIG. 10 at 25 and 26. This projection is used to clip a clip section 27 of a guide ring carrier 28 so that the guide ring 14 illustrated in FIG. 15 can be secured in position at any point along the strip. Similar projections are illustrated with prime numerals to indicate compatibility with the clip of FIG. 15. Prime numerals have been used where like features are present in different embodiments.

Where a heavier effect is required a heavy duty sew on lath is provided and examples are shown with the two examples illustrated in FIG. 11. In order to form a panel roman as illustrated in FIG. 8 a sew on divider strip 29 is illustrated in FIG. 12 and initially this strip is sewn to the fabric 11 to the position as illustrated at 30 and then the legs 31 and 32 are brought together to the position illustrated at 33 and then sewn again through both legs 31 and 32. The legs are sewn closed and thereby this automatically draws in a predetermined section of the fabric. This is a simple accurate method of gathering the fabric.

It will be appreciated that the amount of fabric drawn in depends on the dimensions of the divider strip and therefore as long as the divider is placed correctly in its horizontal position and sewn to the fabric 11 along defined sewing lines the divider strip will always automatically draw in the correct amount of fabric along the full length of the strip.

Figure 13:
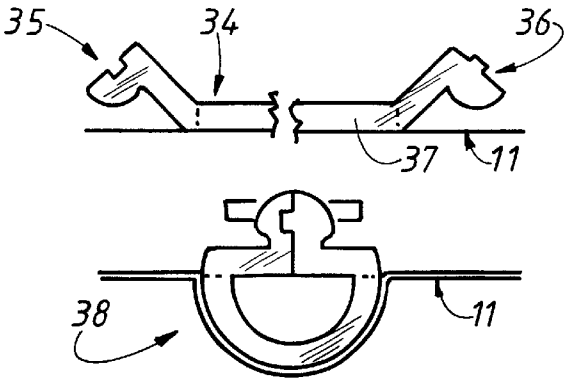
FIGS. 9 to 14 are various divider strips suitable for application of the present invention.

A similar arrangement is illustrated in FIG. 13 for the creation of an oriental roman. In this case a strip 34 is employed the strip 34 including two projecting leg sections at 35 and 36 and a web section 37 so that when the sections 35 and 36 are drawn together to the position illustrated at 38 the respective ends are clipped together and again the fabric will be deformed according to a predetermined geometry determined by the shape and configuration of the divider strip.

Figure 14:
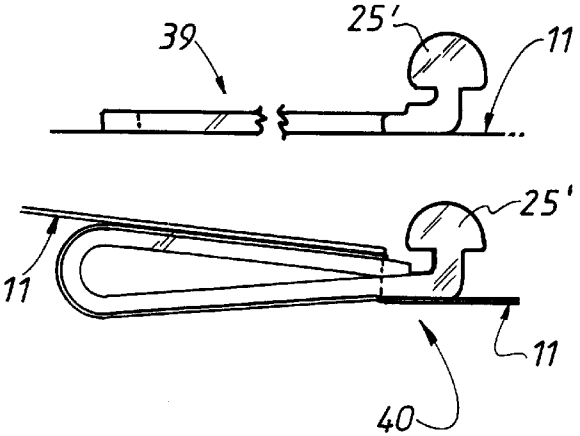

As can be seen in FIG. 14 the baton roman can be made up using a plurality of strips 39 of the type illustrated in FIG. 14. Usually by folding the end of the strip 39 to the position illustrated at 40 again the exact amount of fabric 11 is automatically gathered as illustrated to form in external view the baton type roman blind as illustrated in FIG. 5.

Figure 16:
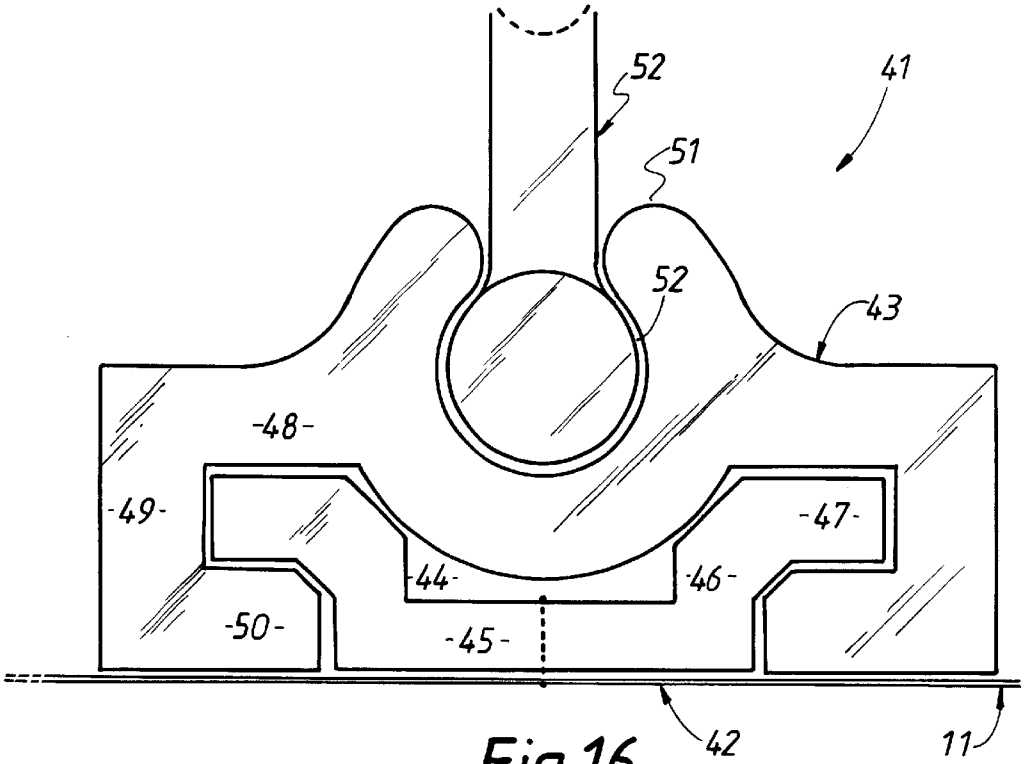
FIG. 16 is a end view of a lath assembly of the present invention.
Figure 17:
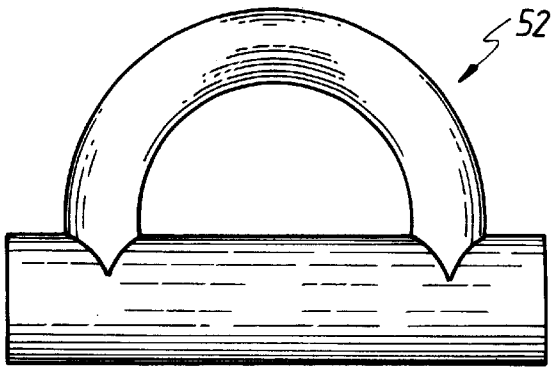
FIG. 17 is a front view of a ring suitable for use with the assembly shown in FIG. 16.

Shown in FIG. 16 is a lath assembly 41. The assembly 41 has a channel shaped strip 42 and a cover member 43 having a restricted recess 44 in which the strip 42 is arranged. The strip 42 has a web portion 45, side wall portions 46 extending from respective ends of the web portion 45 and a flange portion 47 extending outwardly from each end of the side wall portions 46. The recess 44 in the cover member 43 is of a shape substantially complimentary to the shape of the strip 42 so that the strip 42 can be slid into the recess 44 and will remain therein during operation of a shade employing the assembly 41. The cover member 43 has a web portion 48, a side wall portion 49 extending from each end of the web portion 48 and a flange portion 50 extending inwardly from each free end of the side wall portion 49. A ring attachment means 51 is arranged in the web portion 48 for receiving a cord guide ring 52. The ring attachment means 51 as shown in FIG. 16 has an opening 52 into which the ring 52 can be slightingly fitted. FIG. 17 illustrates an example of the cord guide ring 52 suitable for the assembly 41. In use the shade fabric 11 is sewn to the strip 42 along the part of the strip shown in dotted lines and the ring attachment means 51 side of the assembly 41 is normally arranged adjacent to a window. Light through the window will be blocked by the cover member 43 and therefore a person standing in front of the shade will not see any light through stitch holes in the strip 42. The lath assembly 41 can be dimensioned to suit shades of different sizes. In an application the assembly 41 has a width of about 17.5 mm and a thickness of about 10.5 mm. The strip 42 may have a thickness of about 1.5 mm and can be made of any material with suitable stiffness and typical materials include plastic and aluminium.

Figure 19:
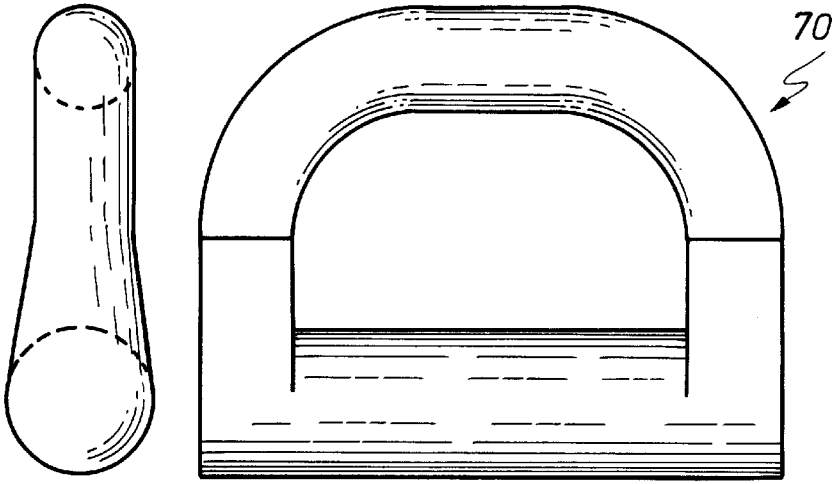
FIG. 19 illustrates a ring suitable for the assembly shown in FIG. 18.
Figure 18:
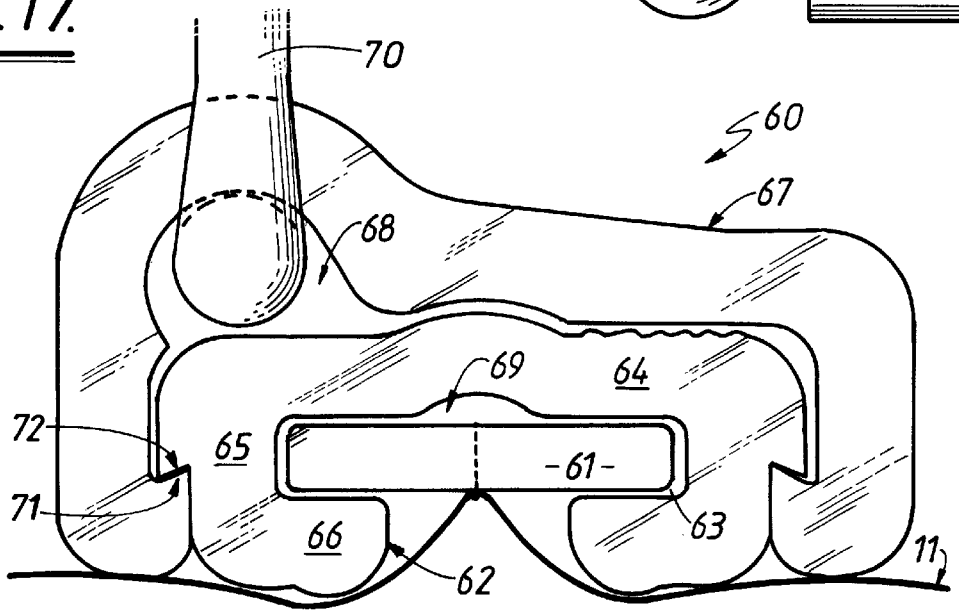
FIG. 18 is an end view of another lath assembly of the present invention.

FIG. 18 shows a lath assembly 60 having a strip 61 arranged within a recess 63 of a cover member 62 and a ring attachment means 67 secured to the cover member 62. The cover member 62 is substantially C-shaped and has a web portion 64, a side wall portion 65 extending from each end of the web portion 64 and flange portions 66 extending inwardly from respective free ends of the side walls 65. The recess 63 has a restricted opening into which the strip 61 is arranged. The web portion 64 has a groove 69 for The ring attachment means 67 is also substantially C-shaped and is removably secured to the cover member 62. The attachment means 67 has an opening 68 for receiving a cord guide ring 70 shown in plan and cross sectional views on FIG. 19. In the assembly of FIG. 18 the attachment means 67 and the cover member 62 have respective complementary projecting parts 71 and notch parts 72 so that the attachment means 67 can be snap fitted onto the cover member 62. In use the shade fabric 11 is sewn to the strip 61 at a position as shown in dotted lines in FIG. 18 and the ring attachment means 67 side of the assembly 60 is normally arranged adjacent to a window. Light through the window will be blocked by the cover member 62 and therefore a person standing in front of the shade will not see any light through stitch holes in the strip 61. As for the assembly 41 of FIG. 16, the assembly 60 can be dimensioned to suit shades of different sizes. In an application the assembly 60 has a width of about 8 mm and a thickness of 10 mm. The strip 61 is about 8.5 mm wide and 1.5 mm thick. The strip 61 and the cover member can be made of any material with suitable stiffness and typical materials are plastic and aluminium.

Figure 20:
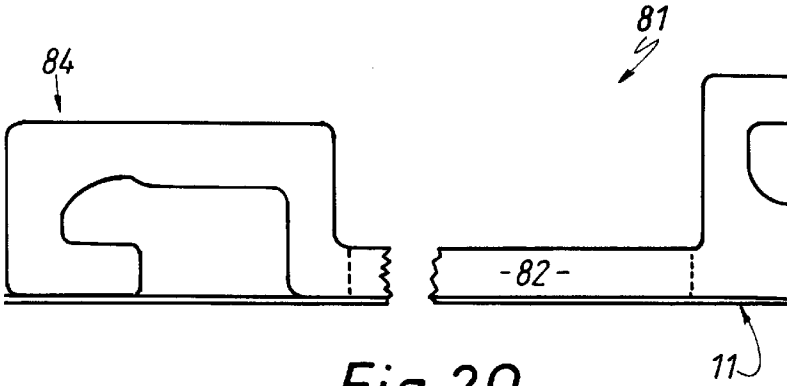
FIG. 20 illustrates a profiled strip for a Baton Roman blind.
Figure 21:
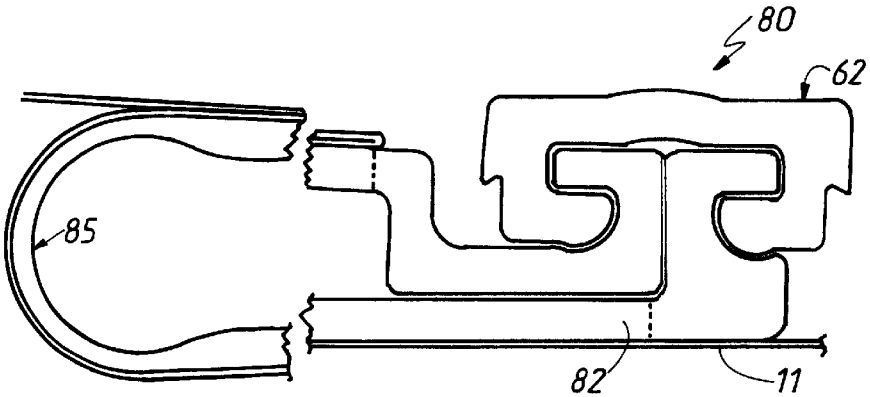
FIG. 21 illustrates a lath assembly for a Baton Roman blind and employing the strip shown in FIG. 20.

As shown in FIGS. 20 and 21 the lath assembly 80 for a Baton Roman blind has a fordable profiled strip 81 and a cover member 62. The cover member 62 in this embodiment is substantially the same as the cover member 62 shown in FIG. 18. Conveniently relevant parts of the description with reference to FIG. 18 are incorporated herein and the same reference numbers for the member 62 in FIG. 18 are used for the cover member in this embodiment. The strip 81 has a web portion 82, a first side portion 83 and a second side portion 84. The first side portion 83 extends perpendicularly from one edge of the web portion 82 and is substantially C-shaped. The second side portion 84 extends side ways from the opposite edge of the web portion 82 and is also substantially C-shaped. The first side portion 83 and the second side portion 84 are dimensioned and orientated so that when the strip 81 is folded as shown in FIG. 21 the two side portions 83,84 form a substantially T-shaped configuration which can be slid into and maintained within the recess 63 of the cover member 62. The strip 81 is thereby maintained in the folded position. In use the blind fabric 11 is sewn to the unfolded strip 81 at the positions shown in dotted line and then the strip 81 together with the sewn on fabric 11 are folded and inserted into the recess 63. As the strip 81 has a relatively thinner section 85 in the web portion 82 the pocket formed is flat with a rounded base and this gives a perfect Baton effect. Typically the pocket formed is between 30 to 50 mm wide and the total width of the profiled strip would be between 80 to 120 mm. The assembly 80 also prevents light ingression through the stitch holes. The ring attachment means 67 shown in FIG. 18 may be used on the assembly 80 for attaching rings or ring clips as described previously.

Figure 22:
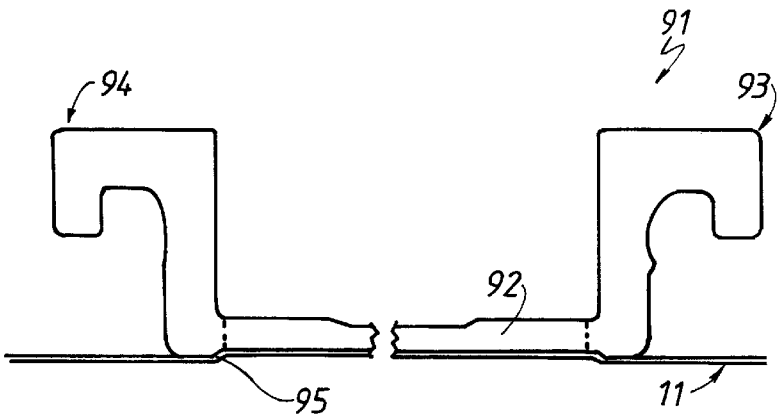
FIG. 22 illustrates a profiled strip for an Oriental Roman blind.
Figure 23:
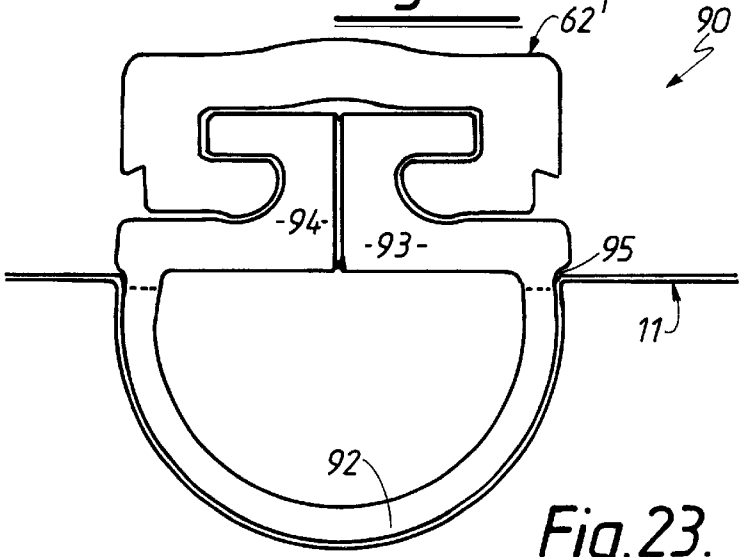
FIG. 23 illustrates a lath assembly for an Oriental Roman blind and employing the strip shown in FIG. 22.

The lath assembly 90 shown in FIG. 23 and the profiled strip 91 shown in FIG. 22 are for an Oriental Roman blind and function similarly to the assembly 80 and the strip 81 in FIGS. 21 and 20 respectively. The width of the web portion 92 and the configuration of the side portions 93 and 94 of the strip 91 however are arranged to effect a rounded shape on the face of the blind. As shown the side portions 93 and 94 are substantially J-shaped and has a shoulder 95 just outside the position where the strip 91 is to be sewn to the fabric 11 of the blind. The shoulders 95 are to aid in the prevention of light ingress when the strip 91 is folded as shown in FIG. 23. Typically the strip 91 is between 15 to 30 mm across the base depending on the size of the ridge required.

Figure 24:
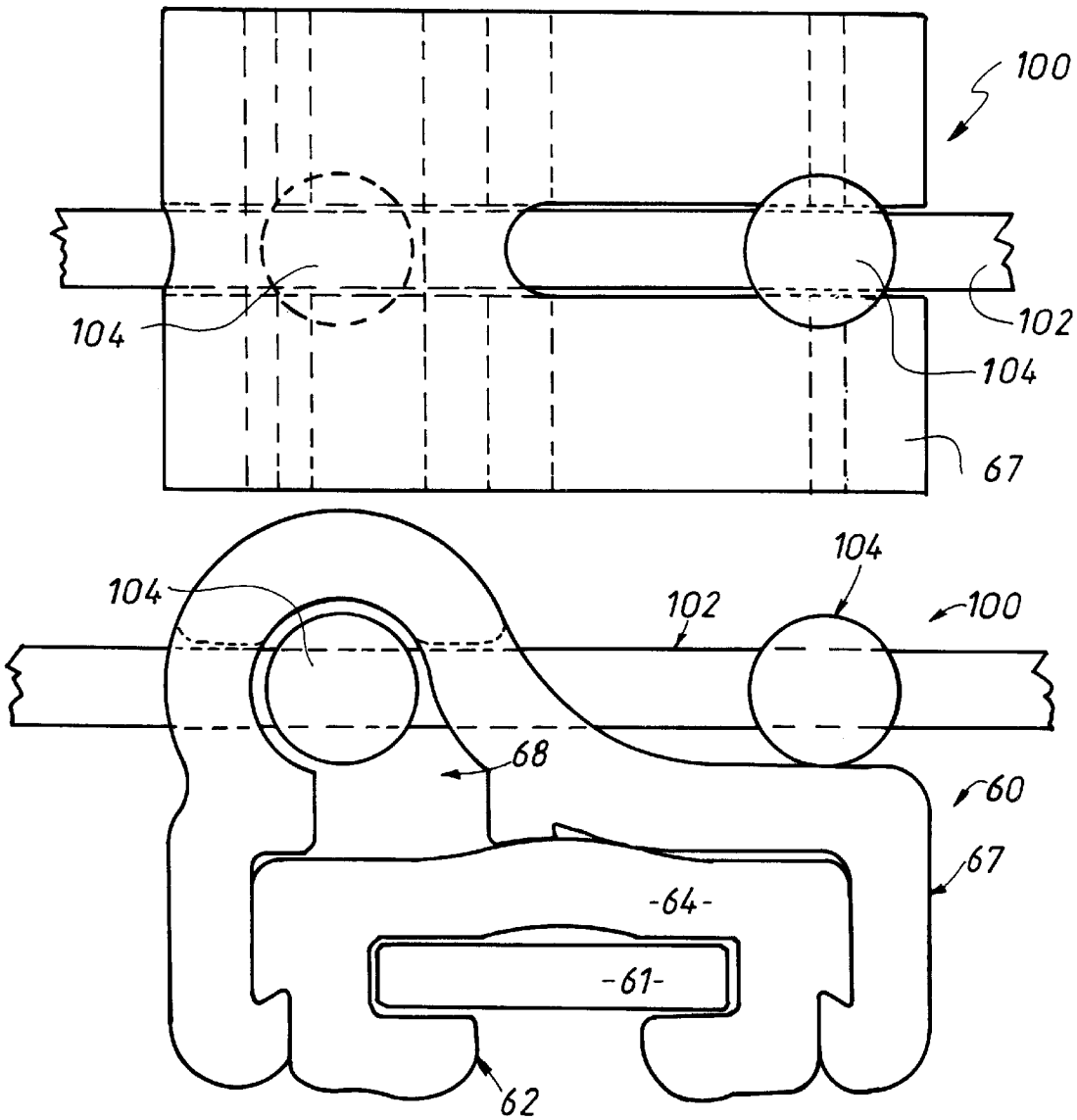
FIG. 24 illustrates a cascade clip used with the assembly shown in FIG. 18.

In FIG. 24 there are shown a plan view and a side view of a clip arrangement 100 for a cascade Roman blind. The lath assembly is substantially the same as that described with reference to FIG. 18 and the description with reference to FIG. 18 which are relevant to this embodiment are incorporated herein. The clip arrangement 100 has at least one chain which includes a cord 102, typically 2 mm diameter, beads 104 arranged spacedly on the cord, typically at 8 mm intervals, and a clip means 67 arranged on selected beads. Preferably the arrangement 100 has between 3 and 8 chains per blind, depending on the width and the weight of the shade. The cords 102 and the beads 104 could be made of any suitable material. One such suitable material is plastic and in which the beads 104 can be moulded on the cords 102. In use a loop (not shown) is formed at an end of each chain. Each loop is secured to a predetermined position on the headboard of the blind. Starting from the top and across the blind a cascade clip 67 is supported on a selected bead 104 of a chain, with the cord in between the two side portions of the clip 67. The lath cover 62 for the top strip 61 of the blind is then clipped into the cascade clips 67 on the top row. The process is repeated for the beads on the next row down. The clip arrangement 100 allows each panel of the blind to be spaced higher than it would normally lie if the blind was flat, and to allow extra fullness in each panel so it loops down to give the cascade Roman look.

Figure 25:
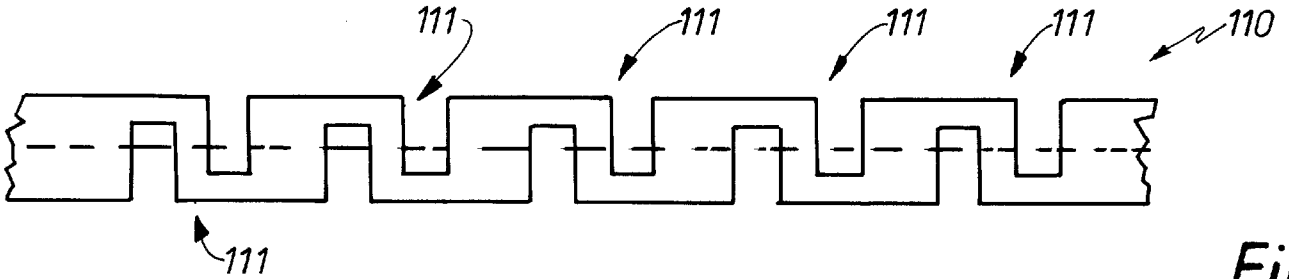
FIGS. 25 to 29 are drawings illustrating further embodiments of the present invention.

Referring to FIG. 25 there is illustrated a lath 110 formed as a serpentine shaped thin plastics strip adapted to flex in response to shade fabric shrinkage particularly in the region of the narrow parts of notch parts 111. As the shrinkage rates of some fabrics can be as high as 4% to 5% the more pairs of notches the larger the shrink rate that can be tolerated. Each notch is typically 3 mm wide×5 mm deep with 2 mm between each notch in the pair 111. Tests have shown that each pair of notches 111 allows approximately 0.5 mm shrinkage and this can be applied for example in the case of one pair of notches per 10 mm over a metre of lath gives for 100 pair of notches providing for 50 mm or 5% shrink that can be accommodated when this sew on lath is sewn onto the shade fabric in the normal manner.

Figure 26:
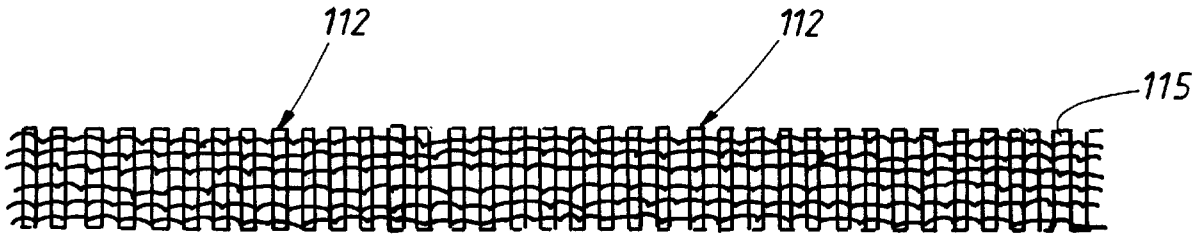

In FIG. 26 spaced ribs 112 allow for shrinkage would be woven wide, width typically 1.2 m to 2 m wide and then cut to the required lath width and then sewn on to the fabric.

Figure 27:
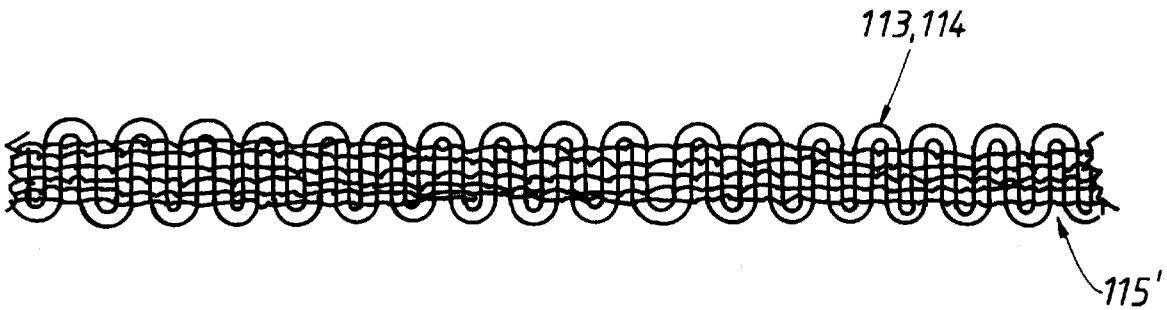

In FIG. 27 the lath is woven from either plastic filament 113 or plastic coated fibreglass thread 114. It is woven to the width required with fibre thread 115. The gaps between the main filament 113, 114 allow for compression.

Figure 29:
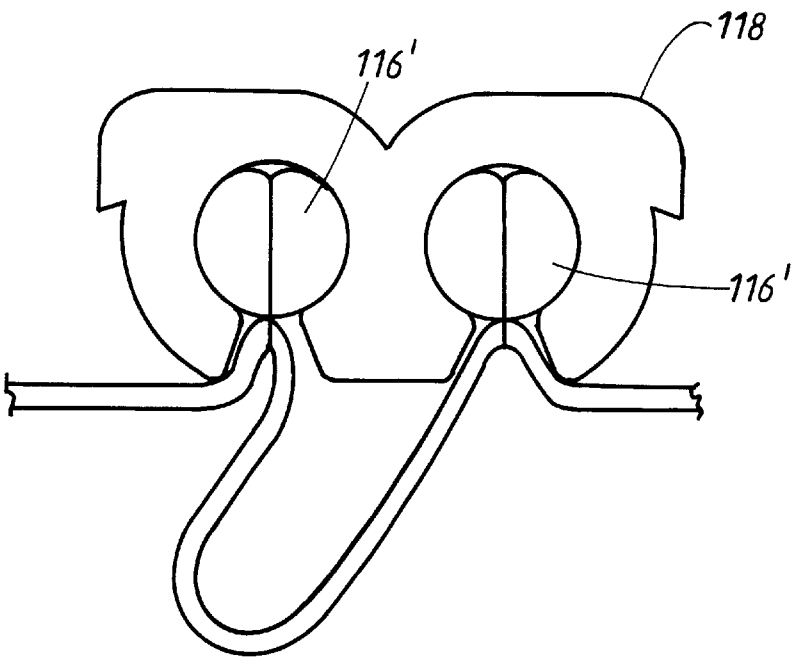
Figure 28:
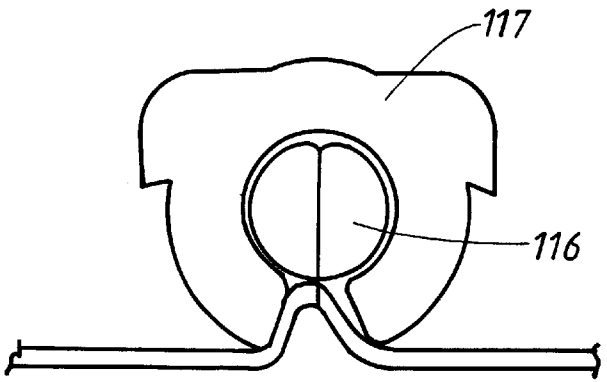

FIGS. 28 and 29 illustrate use of a 4 mm cord 116 sewn directly to the shade fabric through the centre of the cord. The fabric is folded on the stitch line, thereby concealing or disguising it by reason of a cover strip 117, 118 slid over or otherwise coupled to the cord 116. Rings and clips as previously described can be attached to the cover strips 117, 118, In FIG. 29 there is illustrated application to an "oriental Roman" blind where two cords are sewn simultaneously to the skin of the blind at a distance apart determined by the foot of a twin needle sewing machine. Then the two cords are inserted into the cover strip 118 effectively gathering the fabric to give an oriental deformation in the front of the blind.

Other configurations as previously described can be made using this particular method simply by employing variations on the cord position and configuration of the cover strip.

Figure 30:
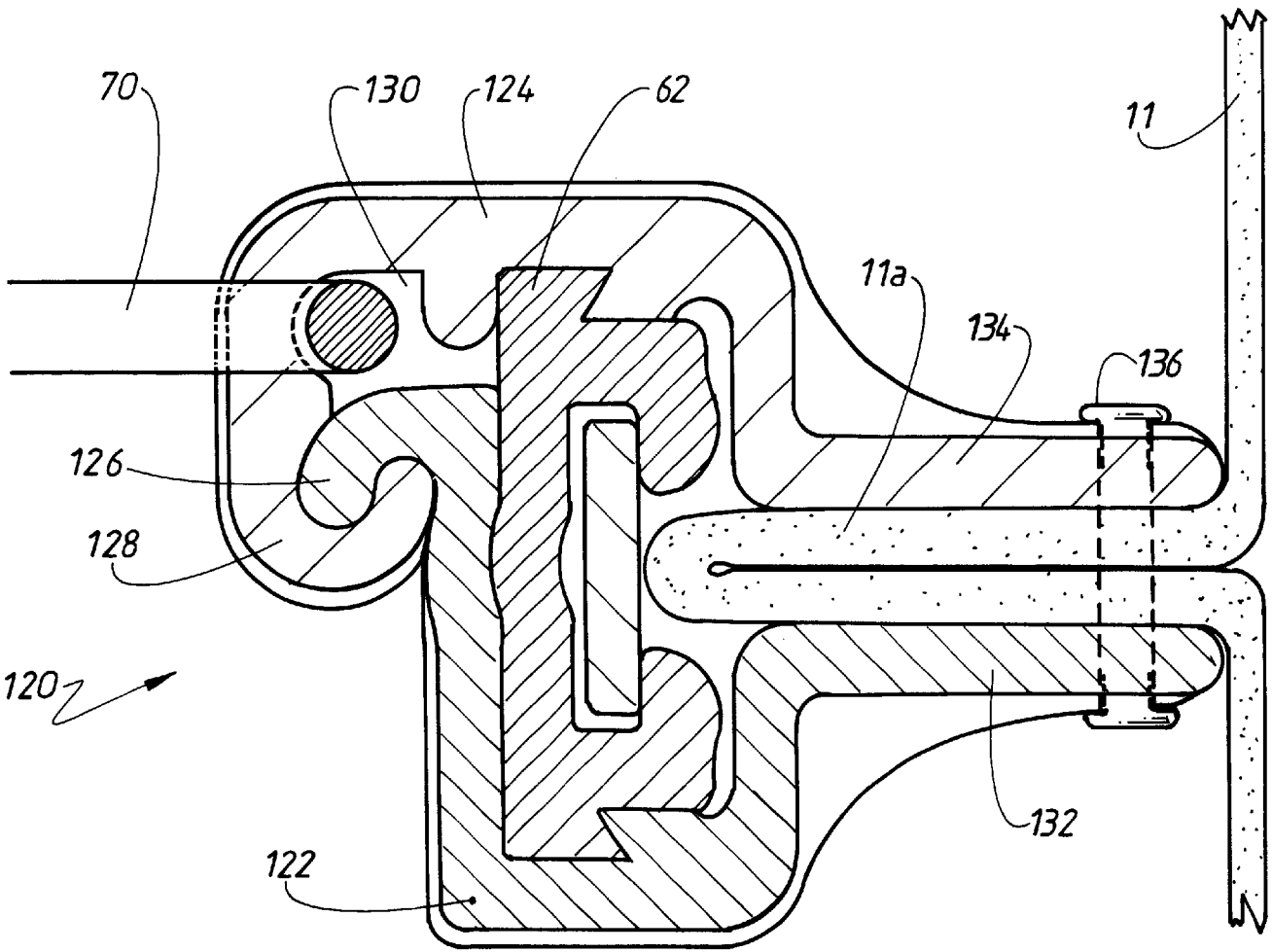
FIG. 30 illustrates a further embodiment of the lath assembly according to the present invention.

In FIG. 30 there is shown a clip member 120 for securing a folded portion 11*a* of the fabric 11. The clip member 120 in this case incorporates the divider strip 61 and the cover member 62 described earlier with references to FIGS. 18 and 24.

The clip member has a first part 122 and second part 124. Compatible portions 126, 128 of the respectively first and second parts 122, 124 are adapted to be snap fitted together as shown. The D-ring 70 described earlier is accommodated in the space between the parts 122, 124.

As shown a jaw portion 132 of the first part 122 and a jaw portion 134 of the second part 124 are arranged for receiving the folded portion 11*a* of the fabric 11. The jaws 132, 134 and the folded portion 11*a* are secured together by a tube rivet 136.

Figure 31:
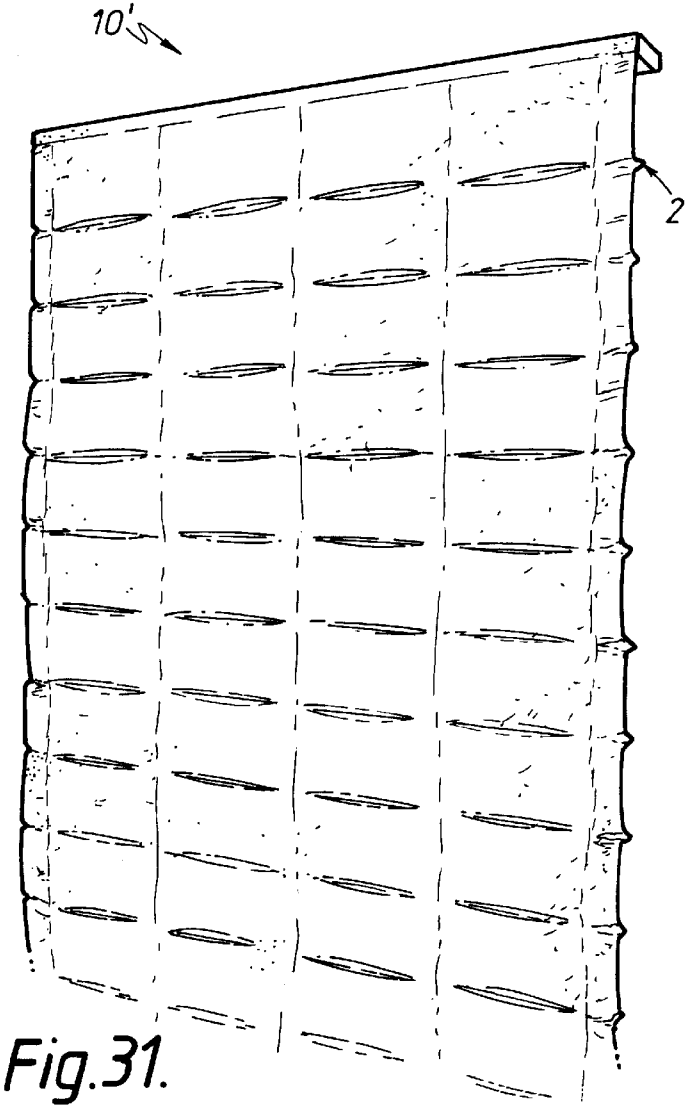
FIG. 31 illustrates a brick patterned roman blind according to the present invention.

FIG. 31 is a brick patterned roman shade 10. The brick pattern is formed by deformations or open pockets between adjacent clip members 120 along the divider strip 12. In the example shown the clip members 120 are spaced approximately 300 to 400 mm apart across the width of the fabric 11 on both the lift lines and the breaker lines, and are aligned vertically to give the stacked brick pattern.

Other patterns may be formed by changing the positions of the clip member 120.

Figure 32:
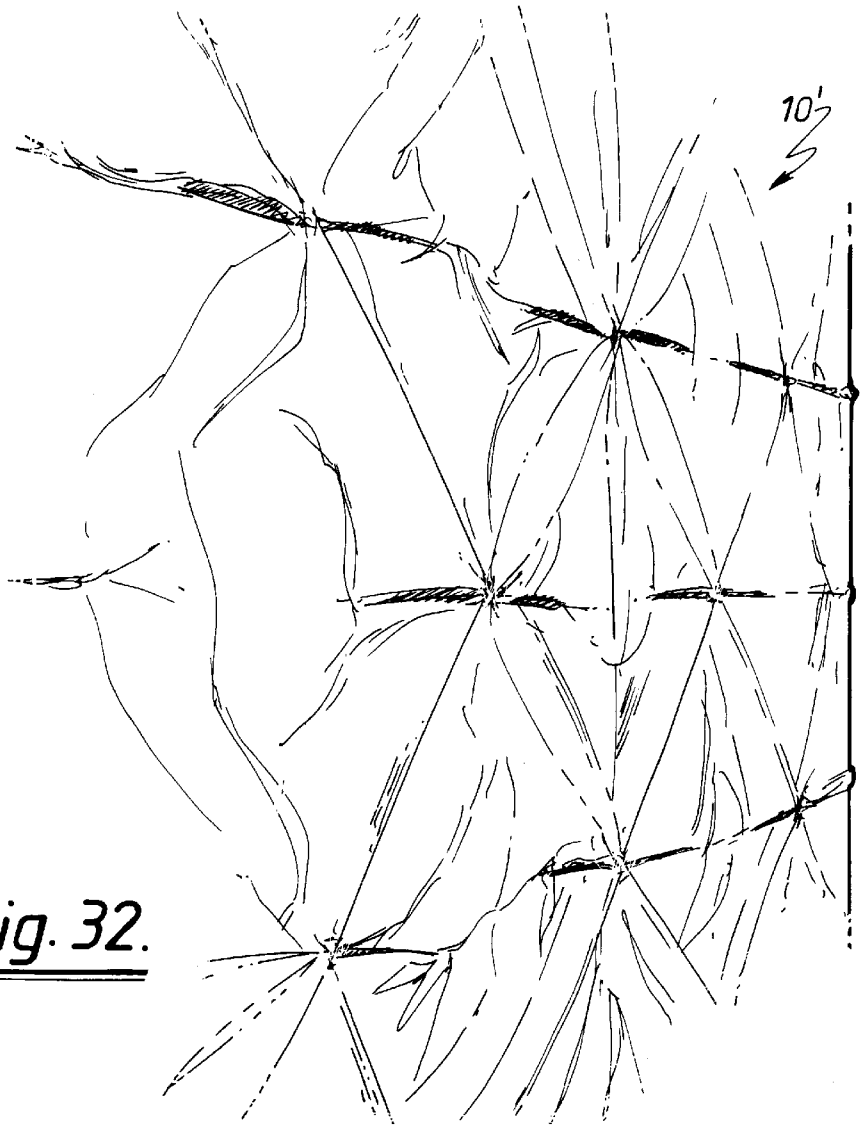
FIG. 32 illustrates a diamond patterned roman blind according to the present invention.

FIG. 32 shows a diamond patterned shade 10. As shown the shade 10 has clip members 120 spacedly arranged along the divider strips 12 forming the lift lines and offset spaced clip members 120 along the strips 12 forming the breaker lines.

Whilst the above has been given by way of illustrative example of the present invention many variations and modifications thereto will be apparent to those skilled in the art without departing from the broad ambit and scope of the invention as set forth in the appended claims.

What is claimed is:

1. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each divider strip is a folded strip secured directly to the fabric at positions spaced longitudinally along the strip.

2. A shade according to claim 1, wherein a cover member is coupled to each of the divider strips.

3. shade according to claim 1, further including a plurality of clip members secured to the fabric at predetermined positions thereby gathering the fabric to form a pattern.

4. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein the divider strips are secured to the fabric using exposed stitching and the divider strip is sufficiently thin that light transmits through stitch holes formed by the stitching process and a cover member is coupled to the divider strip to block transmission of light passing through the stitch holes.

5. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each divider strip comprises a closely space pair of flexible cords adapted to compensate for shrinkage of the fabric.

6. A shade according to claim 5 where a cover member is coupled to each pair of the cords, the cover member having spaced cord attachment means spaced closer together than the spacing between the cords and gathering the fabric to automatically provide a desired shade type.

7. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip is channel shaped, and a cover member having a recess configured to retain the strip in the recess, the strip having a longitudinally extending web portion defined between opposed side wall portions extending from the web portion, the fabric being secured to the web portion.

8. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip is a flexible filamentary material which is arranged for allowing lateral and/or longitudinal adjustment of the strip to compensate for shrinkage.

9. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip has longitudinally spaced notches arranged for allowing limited flexibility of the strip to compensate for shrinkage.

10. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip is made from a flexible filamentary material which is shaped into a serpentine form and adhered to the fabric.

11. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip is made from discrete elements secured at spaced intervals to the shade fabric so that the elements can move to compensate for shrinkage of the fabric.

12. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip is retained in a cover member, the cover member having opposed legs projecting between the strip and the fabric adjacent the strip and the fabric adjacent the strip being drawn thereby into the cover member and being displaced marginally outside the plane of the fabric to provide a shallow pleat in the fabric.

13. A shade comprising a continuous fabric having divider strips spaced on the fabric for dividing the fabric into panels of predetermined outline, each divider strip being secured directly to the fabric in fixed relation thereto by longitudinal fastening and draw cords extending in operative relation to the divider strip so that the divider strips form focal lines for folding of the fabric as the cords are drawn, wherein each strip received in a recess of a cover member arranged to cause the fabric to be drawn into the cover member to provide a shallow pleat in the fabric.

14. A shade having defined panels comprising:

a continuous shade fabric;

strips secured to the fabric at intervals dividing the fabric into selected shade panels, wherein each strip is secured to the fabric by a sewing, said strips deformable to configure the margin of each panel to define a shade of a predetermined shape; and at least one draw cord coupled to a strip for gathering the panels in a stacked relation as the cord is drawn to raise the shade.

15. The shade of claim 14 wherein each strip is deformable to define a rounded margin for the panel.

16. The shade of claim 14 wherein each strip is deformable to gather the fabric to a pleat.

17. The shade of claim 14 further including a cover member to receive each strip in its deformed configuration.

18. A shade having defined panels comprising:

an uninterrupted shade fabric;

strips secured to the fabric at intervals dividing the fabric into selected shade panels, said strips defining the margins of the panels cover members each adapted to receive a strip to conceal the connection between the strip and the fabric; and at least one draw cord coupled to a cover member for gathering the panels in a stacked relation as the cord is drawn to raise the shade, wherein each strip is rectangular and the cover members include a cooperatively shaped channel to receive a strip.

19. A shade having defined panels comprising:

an uninterrupted shade fabric;

strips secured to the fabric at intervals dividing the fabric into selected shade panels, said strips defining the margins of the panels cover members each adapted to receive a strip to conceal the connection between the strip and the fabric; and at least one draw cord coupled to a cover member for gathering the panels in a stacked relation as the cord is drawn to raise the shade, wherein each strip is a flexible cord and the cover members include cylindrical channels to receive the cords.

* * * * *

UNITED STATES PATENT AND TRADEMARK OFFICE

CERTIFICATE OF CORRECTION

PATENT NO. : 6,497,264 B1
DATED : December 24, 2002
INVENTOR(S) : Stefan Zigmas Paskevicius It is certified that error appears in the above-identified patent and that said Letters Patent is hereby corrected as shown below:

Column 9,
Line 30, insert -- A --

Signed and Sealed this

Twenty-second Day of April, 2003

JAMES E. ROGAN
*Director of the United States Patent and Trademark Office*